US010119527B2

(12) United States Patent
Krauss

(10) Patent No.: US 10,119,527 B2
(45) Date of Patent: Nov. 6, 2018

(54) SELF CONTAINED ION POWERED AIRCRAFT

(71) Applicant: Ethan Daniel Krauss, Cleveland, OH (US)

(72) Inventor: Ethan Daniel Krauss, Cleveland, OH (US)

( * ) Notice: Subject to any disclaimer, the term of this patent is extended or adjusted under 35 U.S.C. 154(b) by 402 days.

(21) Appl. No.: 14/821,216

(22) Filed: Aug. 7, 2015

(65) Prior Publication Data

US 2016/0040658 A1 Feb. 11, 2016

Related U.S. Application Data

(60) Provisional application No. 62/034,394, filed on Aug. 7, 2014.

(51) Int. Cl.
*F03H 1/00* (2006.01)

(52) U.S. Cl.
CPC ..... *F03H 1/0018* (2013.01); *F03H 1/0037* (2013.01)

(58) Field of Classification Search
CPC .... F03H 1/0006; F03H 1/0018; F03H 1/0037; F03H 1/0043; F03H 1/005; F03H 1/0056; F03H 1/0062; F03H 1/0068; F03H 1/0075
See application file for complete search history.

(56) References Cited

U.S. PATENT DOCUMENTS 2,800,616 A * 7/1957 Becker ..... H01G 9/155 361/508
3,130,945 A * 4/1964 De Seversky ..... F03H 1/0043 244/23 R
3,464,207 A * 9/1969 Okress ..... F03H 1/0087 244/62
6,145,298 A 11/2000 Burton, Jr.
8,112,982 B2 2/2012 Metcalfe, III et al.
2003/0227559 A1* 12/2003 Rouvinen ..... G02B 7/022 348/335
2007/0085486 A1* 4/2007 Okamoto ..... H05B 41/2881 315/209 R (Continued)

FOREIGN PATENT DOCUMENTS

DE 3431543 2/1985
DE 4410833 10/1995
WO 0209259 1/2002

OTHER PUBLICATIONS

Lucas "High Voltage Engineering" 2001.*

(Continued)

*Primary Examiner* — Gerald L Sung
*Assistant Examiner* — William Breazeal
(74) *Attorney, Agent, or Firm* — Tarolli, Sundheim, Covell & Tummino LLP

(57) ABSTRACT

A self-contained ion powered aircraft assembly is provided. The aircraft assembly includes a collector assembly, an emitter assembly, and a control circuit operatively connected to at least the emitter and collector assemblies and comprising a power supply configured to provide voltage to the emitter and collector assemblies. The assembly is configured, such that, when the voltage is provided from an on board power supply, the aircraft provides sufficient thrust to lift each of the collector assembly, the emitter assembly, and the entire power supply against gravity.

18 Claims, 5 Drawing Sheets

(56) References Cited

U.S. PATENT DOCUMENTS

2012/0146555 A1* 6/2012 Ryding ..... H05H 5/04
315/506

OTHER PUBLICATIONS

NASA SpaceFlight.com "Does anyone know what happen to research into Ionocraft or so called Lifters?" 2013.*
Clemens Electro Hydrodynamic EHD Thruster Analysis and Optimization 2009.*
Maxwell Technologies—Products—Ultracapacitors—D Cell Series 2012.*

* cited by examiner

SELF CONTAINED ION POWERED AIRCRAFT

RELATED APPLICATIONS

This application claims the benefit of U.S. Provisional Application Ser. No. 62/034,394, filed Aug. 7, 2014, which is hereby incorporated by reference in its entirety for all purposes.

TECHNICAL FIELD

The present invention relates generally to the field of aeronautical devices, and more particularly to a self contained ion powered aircraft.

BACKGROUND OF THE INVENTION

An ionocraft, or ion-propelled aircraft, is an electrohydrodynamic device that utilizes an electrical phenomenon known as the ion wind effect to produce thrust, without requiring any combustion or moving parts. In its basic form, it simply consists of two parallel conductive electrodes, one in the form of a fine wire or needle point and another which may be formed of either a wire, grid, or streamlined tubes with a smooth round upper surface. When such an arrangement is powered by high voltage in the range of tens of kilovolts, it produces thrust.

Ionocraft provide a number of advantages, including an absence of moving parts, lower friction losses, as compared to a helicopter, due to no spinning blades or gears, and lower production cost due to simpler construction. The craft can avoid many of the speed limiting factors of a helicopter or jet, with the maximum speed is only primarily limited by the power to weight ratio of the power supply input. Compared to a chemical rocket, ion powered flight is far more efficient, has a better delta-v potential and nearly infinite specific impulse, since it can operate as an air breathing device and does not necessarily need to carry any propellant onboard.

SUMMARY OF THE INVENTION

In accordance with an aspect of the present invention, a self-contained ion powered aircraft assembly is provided. The aircraft assembly includes a collector assembly, an emitter assembly, and a control circuit operatively connected to at least the emitter and collector assemblies and comprising a power supply configured to provide voltage to the emitter and collector assemblies. The assembly is configured, such that, when the voltage is provided, the self contained ion powered aircraft provides sufficient thrust to lift each of the collector assembly, the emitter assembly, and the control circuit against gravity.

In accordance with another aspect of the present invention, an ion powered aircraft assembly includes a collector assembly comprising at least three substantially concentric conductive elements, an emitter assembly, and a control circuit operatively connected to at least the emitter and collector assemblies and comprising a power supply to provide voltage to the emitter and collector assemblies.

In accordance with yet another aspect of the present invention, an ion powered aircraft assembly includes a collector assembly, an emitter assembly, and a control circuit operatively connected to at least the emitter and collector assemblies. The control circuit includes a power supply configured to provide voltage to the emitter and collector assemblies and a resonant transformer that is continuously driven at an associated resonant frequency to provide a high voltage signal to another component of the control circuit.

DETAILED DESCRIPTION

An ion and/or electron powered aircraft is presented that is able to carry its own power source, fly efficiently, and fly almost silently and under complete directional control. Previous efforts in this field have failed to even approach a craft that can lift the complete power source against gravity. In several current implementations the device is entirely self-contained including the power source and is able to lift itself against gravity off of the ground also, it can fly longer than a helicopter of similar weight. In one possible implementation, the device could be reconfigured to operate outside of the atmosphere by carrying its own propellant or by releasing very high voltage energetic electrons below the craft.

The inventor has made such a craft practical through a series of innovations including integrating the electronics into an economic single chip design, selecting optimal shaped collector and emitter assemblies for ideal lift-to-weight ratios, selection of electrical components for efficiently providing a high voltage differential across the emitter and the collector, and using an increased distance between the collector and the emitter. In one implementation, a closest distance between a conductive portion of the collector and conductive emitter wires of the emitter is more than fifteen percent of a width of the collector assembly. Direct conversion of electrical energy into kinetic propulsion for the aircraft results in a new qualitative leap in the development of aerospace/aviation. This device has a highly efficient long running low power drive. Significantly higher lift is technically possible and propellant usage can be greatly reduced or, in the case of the ions, replaced with electrons partially or completely, at very high voltages.

Figure 1:
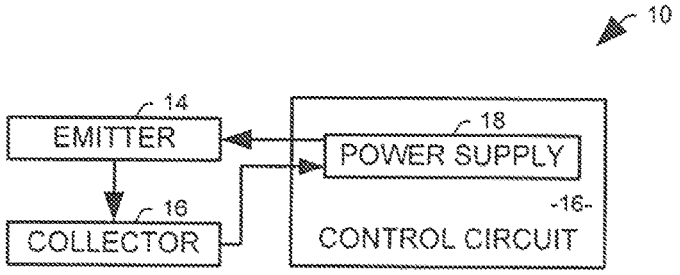
FIG. 1 illustrates an abstract, functional block diagram of a self contained ion powered aircraft assembly in accordance with an aspect of the present invention.

FIG. 1 illustrates an abstract, functional block diagram of a self contained ion powered aircraft assembly 10 in accordance with a primary aspect of the present invention. The phrases "ion powered" or "ionocraft" are used herein to describe a craft that uses a high-voltage electric field to propel charged particles away from a direction of motion, and it will be appreciated that the phrase is intended to cover both ion-propelled and electron-propelled devices. The self powered ion powered aircraft assembly 10 includes a collector assembly 12, an emitter assembly 14, and a control circuit 16 operatively connected to at least the emitter assembly and including a power supply 18 configured to provide a high voltage to the collector assembly 12. Accordingly, a strong electric field is produced between the collector 12 and the emitter 14, allowing for the ionization and acceleration of particles within the region between the collector and the emitter.

It will be appreciated that each component of the self contained ion powered aircraft assembly 10 is configured, including the collector assembly 12, the emitter assembly 14, the control circuit 16, and the power supply 18, in order to efficiently provide thrust with an extremely low-weight system. As a result of the many integrated improvements in ion propulsion, when the voltage is provided, the self powered ion powered aircraft provides sufficient thrust to lift each of the collector assembly 12, the emitter assembly 14, the control circuit, and the power supply 18 against gravity, providing self contained ion powered flight. It will be appreciated that by "lifting against gravity," it is meant that the ion powered craft is capable of rising on its own power from the surface of the Earth with no assistance from lighter than air devices or external power sources.

In one implementation, the collector assembly 12 can include a plurality of concentric elements, with a central support of the device located at a common centroid of the plurality of concentric elements. For example, circular, elliptical, or hexagonal elements can be configured to be concentric and joined by one or more supports. Alternatively, the collector assembly 12 can be configured as an elliptical, circular, or hexagonal spiral assembly with appropriate supports. The collector assembly is generally made from a lightweight material having at least a conductive portion. Example materials can include aluminized polyester film and carbon fiber, either with or without a metallic film. The concentric elements forming the collector can be tapered such that a first edge of the collector assembly facing the emitter assembly is wider than a second edge, opposite the first edge, facing away from the emitter assembly.

The emitter assembly 14 can be implemented as a series of thin, conductive wires extended above the conductive elements within the emitter assembly. In one implementation, the emitter assembly 14 and the collector assembly 12 are separated by a plurality of supports holding up an emitter wire support structure that support the conductive emitter wires. In one example, the emitter wire support structure comprises a rigid outer member, a series of radial threads attacked on at least one end to the rigid outer member, and a plurality of concentric threads supported by the series of radial threads, with the conductive emitter wires being attached along the plurality of concentric threads. In one example, the threads are nylon threads, and the rigid outer member is formed from boron.

In one example, the power supply 16 can include any appropriate components for providing a large voltage between the collector assembly 12 and the emitter assembly 14, for example, on the order of thirty thousand volts. In one example, the power supply 16 could be implemented as a series of thin film batteries connected in series to provide the desired voltage. In another implementation, the power supply 16 can utilize an inverter, such as a modern version of Royer circuit, to feed a specialized transformer with a very high turn ratio, to provide the necessary voltage. In still another implementation, discussed in detail in FIG. 5 below, an inverter, a transformer, and a voltage multiplier are used to provide the desired voltage.

Figure 2:
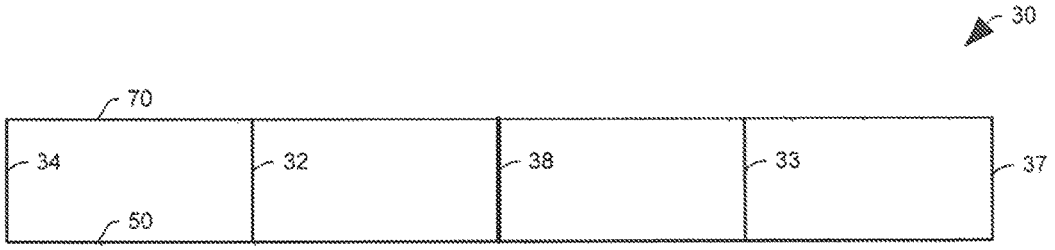
FIG. 2 illustrates an example implementation of an improved ionocraft in accordance with an aspect of the present invention, shown in a side view.
Figure 3:
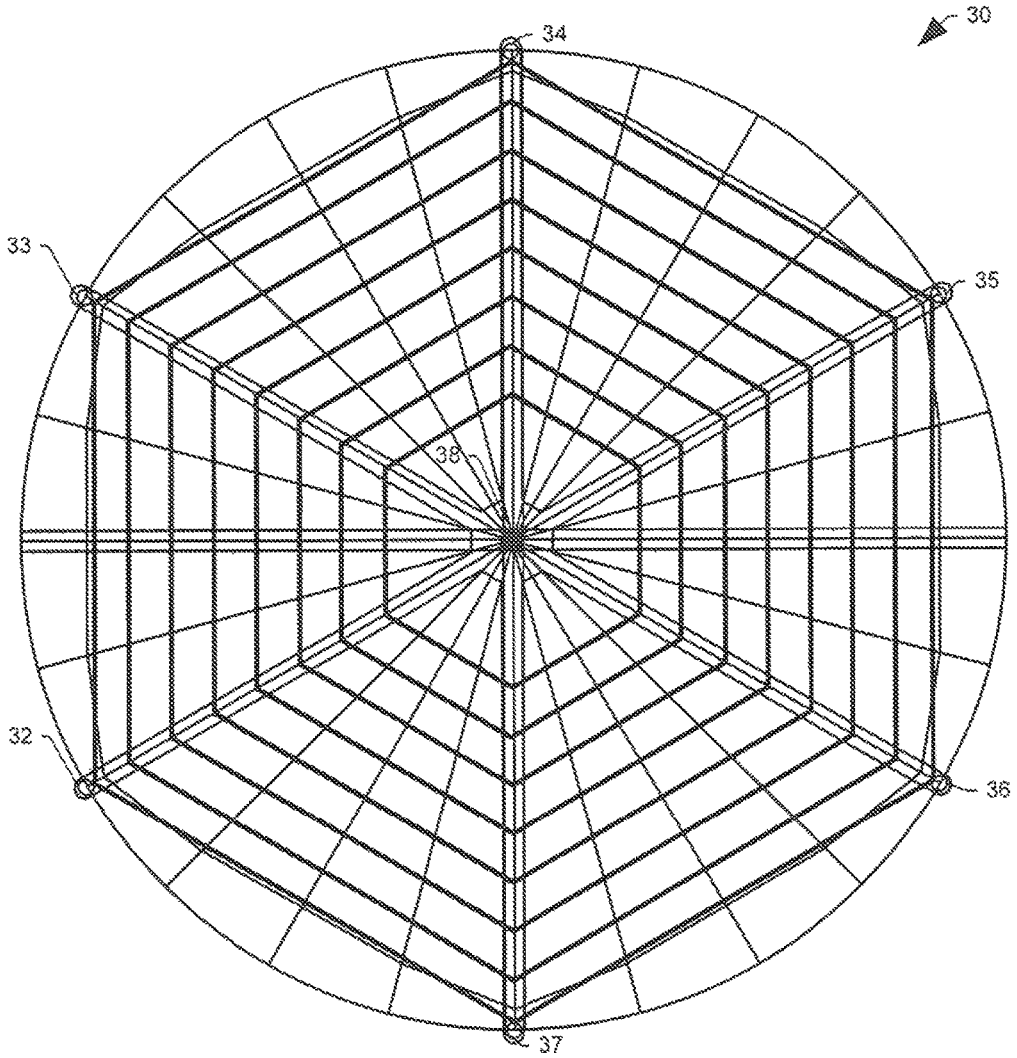
FIG. 3 shows a top view of the device of FIG. 2.

FIG. 2 illustrates an example implementation 30 of an improved ionocraft in accordance with an aspect of the present invention, shown in a side view. FIG. 3 shows a top view of the device 30 of FIG. 2. In the illustrated implementation, the device 30 includes seven support structures 32-38 separating a collector assembly 50 from an emitter assembly 70. The device has a width of about thirty-nine inches, and the separation between the collector assembly 50 and the emitter assembly 70 can be between six and eight inches, with a difference of between at least twenty five to thirty kilovolts produced between the collector and the emitter. In the illustrated implementation, a set of peripheral supports 32-37 are formed from thin-walled plastic, with a central support 38 formed from either thin-walled plastic or a flexible circuit board. In one implementation, the supports 32-38 can be hollow tubes having walls around one to three thousands of an inch, that is, one to three mil. A control circuit 100 is located in the central support 32.

Figure 4:
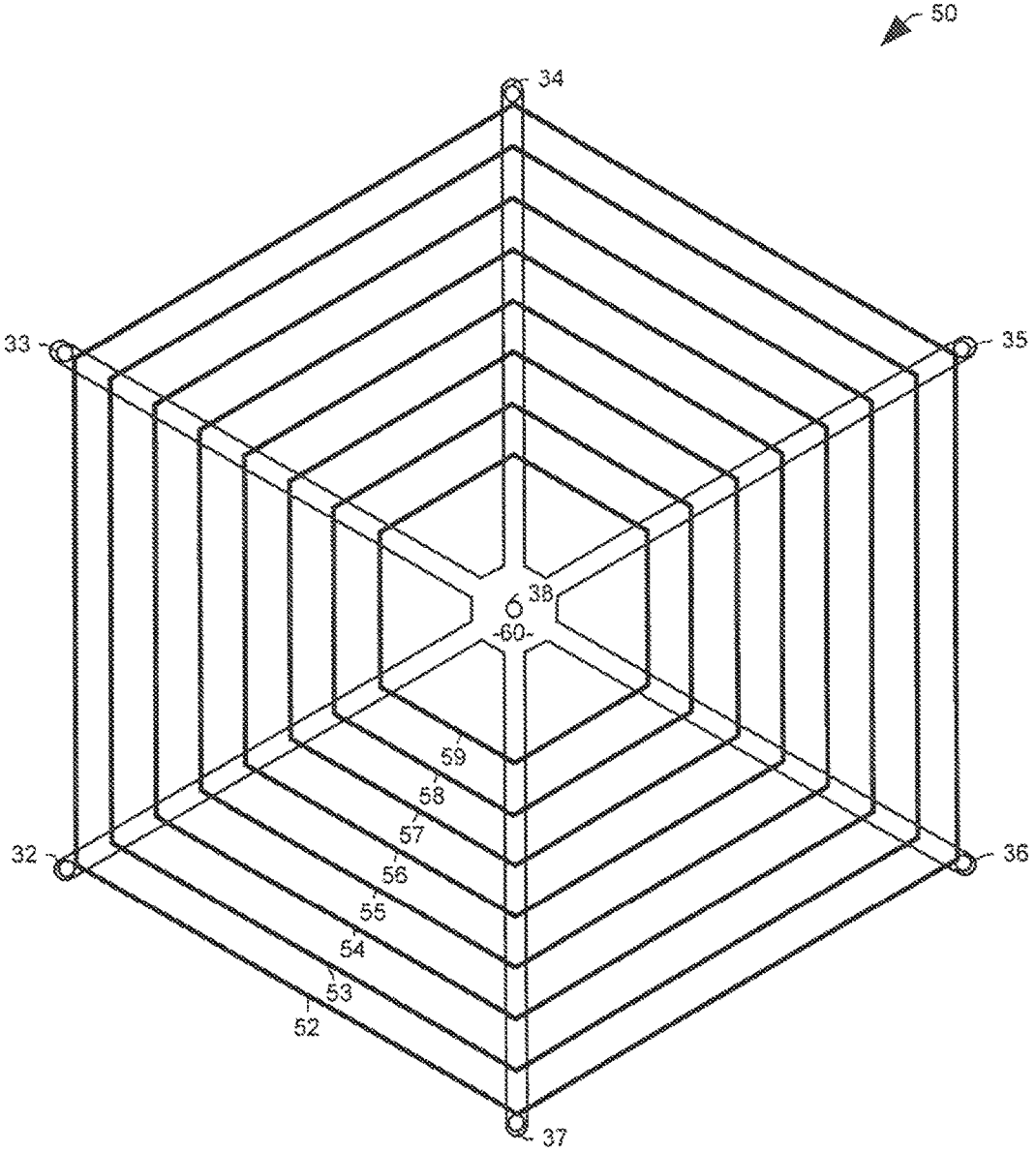
FIG. 4 illustrates a collector assembly for the example implementation of FIGS. 2 and 3.

FIG. 4 illustrates the collector assembly 50 for the example of FIGS. 2 and 3. The collector assembly 50 comprises a series of substantially concentric conductive or semi-conductive elements 52-59 supported by a lateral support structure. The inventor has determined that any points on an ionocraft concentrate the electrical energy to the point of producing heat and thereby wastes energy. Accordingly, by spreading the energy out in an even manner that lift is produced more efficiently. Further, the device is enhanced by balancing the stress and strain forces on the hyper light materials around a center of gravity in a radial manner. Any imbalance of forces or weight of materials may cause the lightweight structure to warp or be relatively less robust. Accordingly, the inventor has found that spiral or concentric conductors, having a minimum number of corners, to provide a superior collector assembly.

In the illustrated implementation, the collector assembly 50 includes eight hexagonal structures 52-59 all sharing a common center collated with the central support 38. In the illustrated implementation, the collector elements 52-59 have cross-sectional shapes in which the edge of each collector element closest to the emitter 70 is wider than the edge farthest from the emitter and rounded, to form a "tear drop" shape, with having the rounded edge facing the emitter. In one implementation, the collector can have a thickness of about four mm at its widest point, and height of about twelve mm. In the illustrated implementation, the concentric elements 52-59 are fabricated from carbon fiber, specifically carbon fiber veil. In one example, the concentric elements 52-59 can be coated with a metallic film (e.g., aluminum) to further enhance the electrical conductivity.

In another implementation, an aluminized plastic can be used to form the collector assembly as plastic shrink tubing. The plastic tubing can be heated and formed around a collapsible mandrel, or, a mandrel that may also use air pressure and or Teflon to assist in the release of the collector segments. In one example, the wall thickness for the plastic shrink tubing is about three microns but different implementations can vary in thickness depending on the implementation. In one implementation, thin polyester, for example, with a wall thickness of 3 microns, is used for the plastic tubing. After the collector surface is formed, the plastic material can be vacuum coated with aluminum or another conductive coating such as clear tin oxide. It might be assumed that such thin walled materials would be inadequate in terms of rigidity, however, when such a material is formed into a tube or streamlined tube structure there is sufficient rigidity to maintain an adequate shape during flight, provided that the collector is supported at sufficient intervals by the boron or other nonconductive or conductive frame.

The concentric elements 52-59 are supported by a base structure 60 comprising six arms extending from a center portion. The central support 38 is connected to the center portion of the base structure 60 and each of the peripheral supports 32-37 are connected at a distal end of one of the arms of the base structure. The base structure 60 can be made from carbon fiber, such as carbon fiber veil, boron, or any other durable, lightweight material. In addition to providing mechanical support to the concentric elements 52-58, the base portion 60 can either be conductive to allow for electrical communication between the control circuit 100 and the concentric elements 52-58, or support appropriate wires or traces to electrically connect the power supply to the concentric elements.

Figure 5:
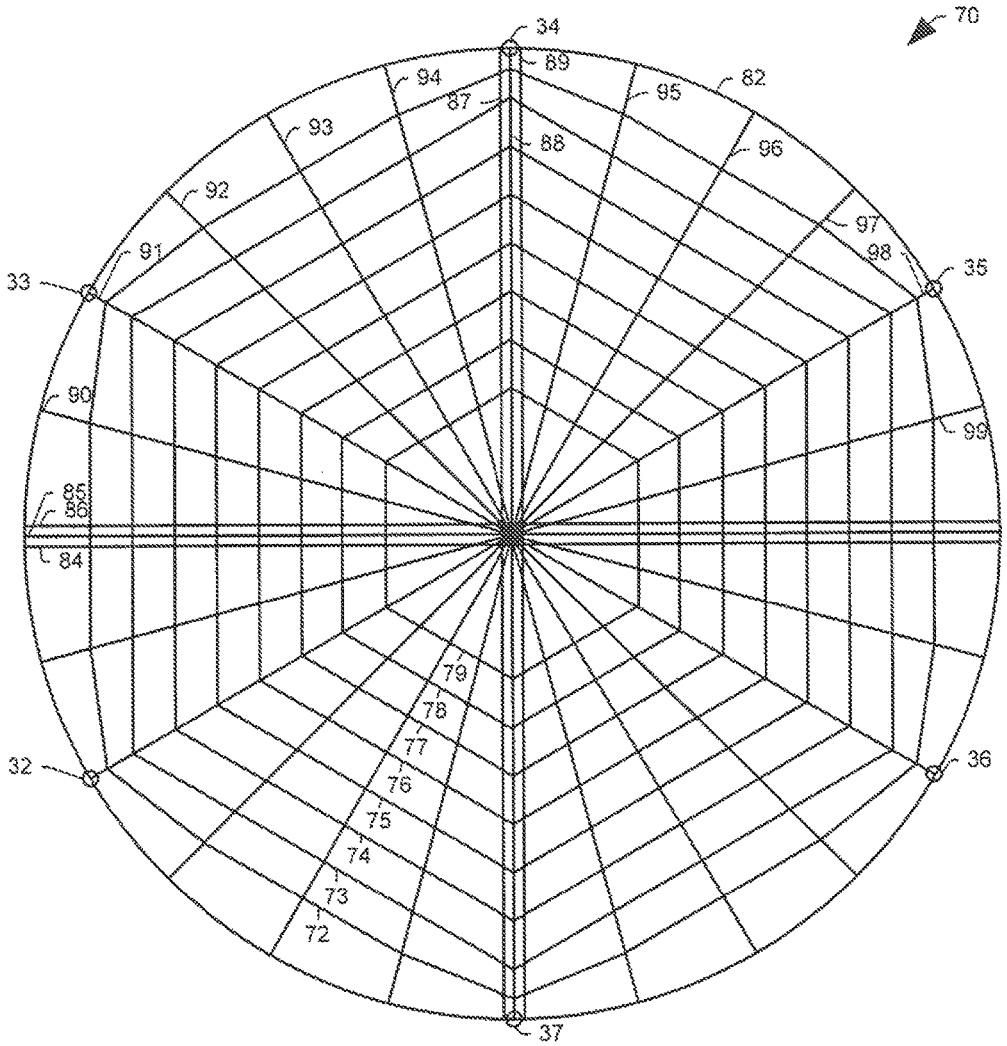
FIG. 5 illustrates an emitter assembly for the example implementation shown in FIGS. 2 and 3.

FIG. 5 illustrates the emitter assembly 70 of the example shown in FIGS. 2 and 3. The emitter assembly 70 can be divided into an emitter wire support structure 72-79 that is spaced from the collector assembly by the plurality of peripheral supports 32-27 and the central support 38, comprising a series of supporting elements each extending within a plane substantially parallel to the collector assembly a plurality of conductive emitter wires supported by the emitter wire support structure. The emitter wire support structure 72-78 can be formed from annealed, pre-shrunk, nylon or other plastic, including Kevlar thread, as well as fishing line. In the illustrated implementation, the emitter wires are joined to the emitter wire support structure 72-79 along their length and are therefore collocated with the emitter wire support structure 72-79 in the illustration of FIG. 5. The emitter wire support structure 72-79 and the emitter wires are located substantially above corresponding concentric elements 52-58 of the collector. To reduce weight in the emitter structure, the emitter wires are formed from conductive wire that is less than five microns in diameter. In one implementation, wire having a diameter of 2.5 microns is used.

The emitter assembly 70 further comprises a rigid outer member 82, supported by the plurality of peripheral supports 32-37. In the illustrated implementation, the rigid outer member 82 is implemented as a boron loop. A series of radial threads 84-99 are attached on at least one end to the rigid outer member. These threads can be formed from the same material as the emitter wire support structure 72-79. In the illustrated implementation, the radial threads are connected on each end to the rigid outer member, but it will be appreciated that twice as many shorter threads could be employed that connect to the central support 38 at a second end. The series of radial threads 84-99 are, in general, separated from one another by distances of fifteen degrees, but it will be appreciated that two perpendicular sets of triplet threads 84-86 and 87-89 are utilized herein for added support.

In the illustrated implementation, the emitter wire support structure 72-79 is implemented as a plurality of concentric threads supported by the series of radial threads 84-99. To assist in steering of the device, the emitter wires themselves can be implemented in four quadrants, each of which are selectively provided with current from the control circuit 100. Accordingly, the emitter wires may not form an entire concentric shape with its corresponding support structure, 72-79, but are instead broken into four individual paths on each support structure, corresponding to the quadrants of the device. In the illustrated implementation, the individual paths begin and terminate at the sets of triplet threads 84-86 and 87-89, such that these threads effectively define the quadrants.

Figure 6:
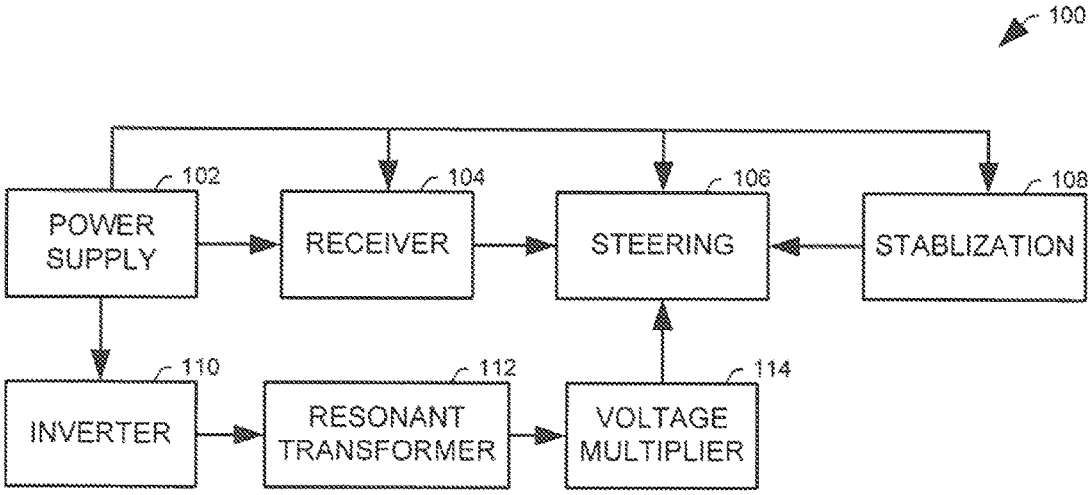
FIG. 6 illustrates a control circuit for the example implementation shown in FIGS. 2 and 3.

FIG. 6 illustrates a control circuit 100 for the example shown in FIGS. 2 and 3. The control circuit 100 includes a power supply 102 that provides power to the various electrical components of the system. In the illustrated implementation, the power supply is implemented as lightweight lithium polymer batteries. Specifically, the illustrated control circuit uses two forty to sixty mAh high rate lithium polymer batteries. They are charged to roughly 4.17 Volts each, 8.34 volts in series. During operation, they provide a little over seven and a half volts, under load, to about six Volts or less at the end of each flight.

A receiver 104 receives commands from the user and provides them to a steering component 106. The steering component 106 can include a plurality of variable resistors that are configured to selectively reduce the voltage difference in each of the four quadrants of the device, such that a difference in lift across the device can be created. In one implementation, the variable resistors are mechanical, with a conductive "wiper" moved by a mechanical actuator across a series of resistor elements to adjust the resistance associated with each of the four quadrants. A stabilization component 108 can also provide input to the steering component 106. For example, an optical flow sensor or a gyroscope chip can be used to resist unintended motion of the device due to wind or other perturbations.

The battery can also drive an inverter 110 configured to provide an alternating current (AC) signal from a direct current provided by the power supply 102. In one implementation, the inverter 110 is implemented as a modified Royer circuit. In another implementation, a pulse width modulation inverter can be used. The inventor has found that the higher q factor of an oversized inductor can be exploited to improve the Royer inverter, and the illustrated control circuit 110 uses an inductor that is larger than what is normally found in the modern version of the Royer inverter. Specifically, where a Royer inverter is used, the inductor in the inverter 110 is at least half of the size, and can be nearly as large, as a resonant transformer 112 driven by the inverter. The gain in efficiency and lift more than outweighs the extra weight of the oversized inductor. Using a push pull inverter for the device, such as the pulse width modulation inverter or the Royer circuit doubles the voltage provided for a given size of the driven transformer 112 and increases the efficiency considerably.

The AC signal from the inverter drives the resonant transformer 112. In the illustrated implementation, a specially insulated and shaped low profile drum shaped high voltage transformer is used. The secondary is wound on the inside and made of well insulated AWG50 wire. The primary is composed of around 20 turns of silver AWG36Q wire. The core is made of relatively high permeability Nickel Zinc due to its low electrical conductivity for micro high voltage applications. The device is used in strike mode, that is, driven at a specific resonant frequency, to produce a continuous three kilovolt output, under light load. Since the transformer is used in this manner the output current is accordingly reduced to no more than about seven hundred microamps.

The output of the resonant transformer 112 is provided to a voltage multiplier 114. In the illustrated implementation, the voltage multiplier 114 is an elongated half wave Cockroft-Walton type voltage multiplier having about twenty-six capacitors or thirteen stages. The stages are significantly extended, such that the voltage multiplier 114 takes up a substantial portion of the length of the central support 38. In one example, the voltage multiplier 114 spans substantially all of the length of the central support. The voltage multiplier device should increase the voltage over about ten times and reduce the current by more than about ten times. The current output of the voltage multiplier can be around thirty to sixty micro-amps. Past ionic or electrostatic/high voltage flying devices have relied on much higher currents in general. This low amount of current is much safer as well as more efficient. In the illustrated implementation, the resulting output current and voltage is about thirty kilovolts at about forty-seven microamps.

The voltage multiplier embodiment has been improved from the classic Cockroft Walton half wave multiplier design for this application. The classic Cockroft Walton design is a ladder network of diodes and capacitors, with diode paths in the middle of the two rows of capacitors making up the ladder network. In the illustrated implementation, the diode paths are curved, so the diode leads are curved convexly in order to form upward facing humps. The purpose of this is that the points that would normally be formed where the diodes connect with the capacitor nodes are now directed in the same direction as the electron flow over the wires. This arrangement results in a much less loss of electrical power without having to add any extra insulating material or large rounded connection points.

The negative output of the multiplier then goes to the emitter wire assembly to be distributed to the four steering quadrants dividing the current by four. This reduces the current to 11.75 micro Amps per quadrant. Since this currents drains down and spreads out as it makes its way across an emitter assembly no one part of that system sees this current value for long. The positive output of the multiplier is provided to the collector assembly 50 to produce the voltage difference. The inventor has determined that lower current higher voltages produce much more efficient propulsion. The reason for this is that the air in this machine displays about 13 Giga-Ohms of resistance at 3 kV and roughly several hundred Mega-Ohms at about 30 kV minimum. Do to the poor conductivity of the air Joule heating becomes significant when much current is present Since there are $6.241\times10^{12}$ electrons per micro-amp, there is about $7.3\times10^{13}$ electrons available per quadrant that could potentially be absorbed by O2 molecules in the ambient and flowing air near the emitter assembly in each quadrant. Since the emitter wires on just one quarter of the craft are exposed to around 1 Mole per second of O2 and there are $6.022\times10^{23}$ particles per mole that implies that something like $6.022\times10^{23}$ O2 molecules are available per second to absorb the $7.3\times10^{13}$ electrons per second. Since the spaces between the O2 molecules are many times the diameter of the molecules themselves, and the molecules are moving around rather fast, this influences the electron absorption/electron affinity of the O2. In general only a small percentage of the oxygen is ionized by the low current electrical discharge of the emitter, a sufficient amount to create a gentle quiet breeze. Colder and or denser air will absorb more electrons.

Figure 7:
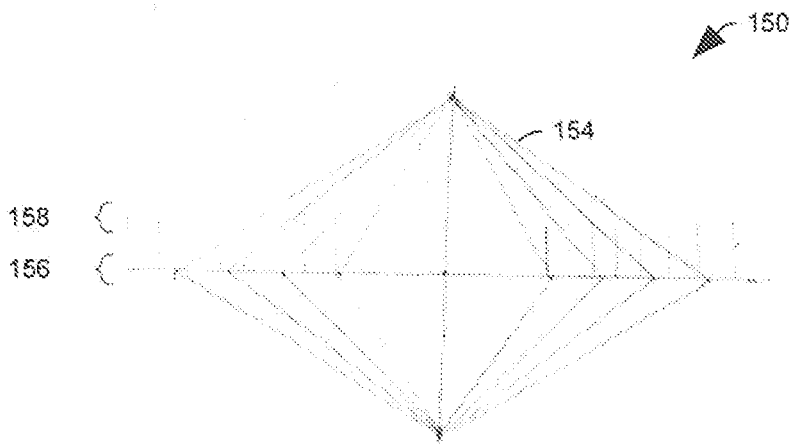
FIG. 7 illustrates another example implementation of an improved ionocraft in accordance with an aspect of the present invention, shown in a side view.
Figure 8:
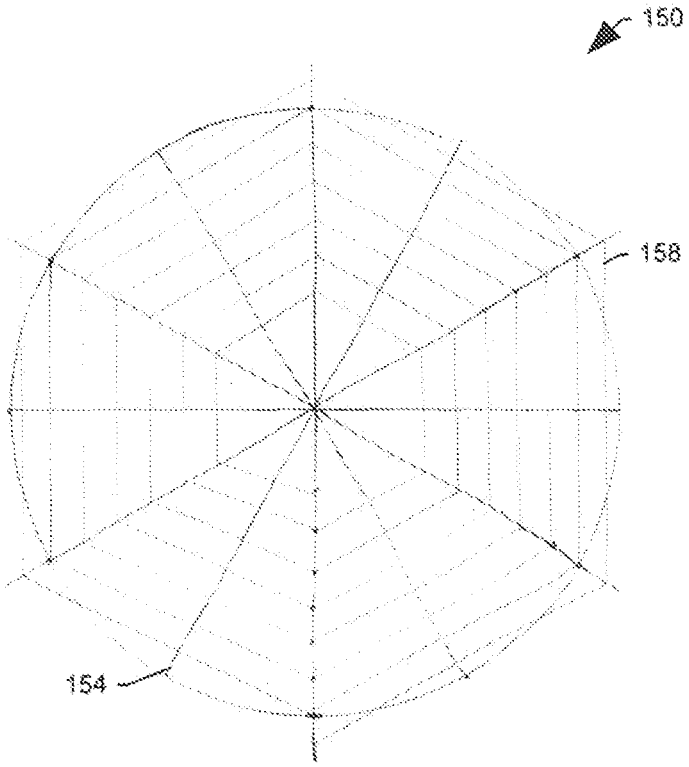
FIG. 8 shows a top view of the device of FIG. 7.

FIG. 7 illustrates another example implementation 150 of an improved ionocraft in accordance with an aspect of the present invention, shown in a side view. FIG. 8 shows a top view of the device 150 of FIG. 7. In the example shown in FIGS. 7 and 8, the basic frame structure has been assembled using 0.008 inch diameter boron filaments rather than carbon fiber or other materials due to the fact that boron is somewhat more rigid by weight and also is a very poor conductor of electricity, which avoids interference with the operation of the collector surfaces. The inventor has discovered that having a single radial shaped structure provided the highest strength to weight ratio. Having several pods or separate structures wastes structural materials and leads to a higher density per lifting force vehicle. The vehicle has a mast protruding vertically above and below the center of the device. The reason for having a mast as such is to provide a connection point for the guy wires shown in FIG. 2. Relatively thin guy wires (e.g., 154) for this version of the craft are placed around every 3 to 4 inches along the spoke like frame members and run to the top of the upper mast and bottom of the lower mast in order to provide vertical structural rigidity with the least possible weight. The guy wires are made of 0.002 inches, may vary, in diameter nylon thread, so as to be light weight but adequate in strength. Previous designs have utilized fewer, larger guywires for support, but the inventor has found that, to the extent feasible, increasing the number of guywires, while lowering their thickness, helps to avoid twisting and achieve sufficient structural rigidity with the least weight.

In the example shown in FIGS. 7 and 8, the collector 156 is made of 3 micron thick aluminized polyester film formed into a hexagonal spiral shape. The shape of the collector has been found to be most efficient if it has a cross sectional shape like a tear drop having the rounded edge facing upwards, a thickness of about 4 mm, and height of about 12 mm. Normally one might assume such thin walled, 3 um, materials to be inadequate in terms of rigidity, however, when such a material is formed into a tube or streamlined tube structure there is sufficient rigidity to maintain an adequate shape during flight, provided that the collector is supported at sufficient intervals by a boron or other nonconductive or conductive frame. As can be seen in FIG. 8, the emitter wires 158 follow a similar hexagonal spiral pattern. The emitter wires are formed from thin (e.g., 2.5 micron) conductive wire supported by nylon, Kevlar, or other thread.

The control circuit for the illustrated device operates similarly to that illustrated in FIG. 6. In this embodiment, the Cockroft Walton half wave multiplier is formed placing all the capacitors in a straight line at intervals and arranging all the wires in between them. The diodes and their leads form arcs or humps between the nodes. This results in a much longer voltage multiplier that needs little or no electrical insulation thereby saving considerable weight. It has been noticed under ultraviolet imaging that corona tends to build up at the ends of shorter voltage multipliers representing significant power losses. A longer voltage multiplier is not only more efficient but can be placed on the upper mast to span the distance between the collector and emitter. Placing the component in this manner as such eliminates the need for "go around wires", wires that are placed in wide arcs around the machine in order to power up the emitter surface without arcing out or requiring heavy insulation. Other improvements in voltage multiplier construction include using optimized capacitor sizes and weights for a given high frequency, optimization of diode size and characteristics, as well as the number of stages for the multiplier that work best for a given ion propulsion machine/system. The inventor has determined that about twenty-four stages is optimal for a craft with around a 7 and ¾ inch gap between the collector and emitter. It has been found that for these voltage multipliers the elimination of the circuit board saves weight and point to point surface mount components is the best type of circuit architecture.

In another implementation, a combination mast/voltage multiplier is used, thereby taking advantage of the structural rigidity of the actual components. In this embodiment a 12 micron thick circuit board was used and rolled into a tube so as to create a tubular voltage multiplier with very thin etched traces, as long as the parts are then separated buy sufficient distances. The device is clearly longer than a normal voltage multiplier, so the capacitors need not be positioned in a single straight line.

The use of a long voltage multiplier spanning the gap between the emitter and collector has been found to significantly improve the performance of the ion powered craft. In one implementation, a double or triple helix arrangement for the capacitor and diode strings in order to eliminate sharp corners can be used. The inventor has also determined that, by putting a spark gap across the inlet to the voltage multiplier and connecting the output ground at the base of the multiplier to the opposite side of it, the multiplier's base a larger voltage can build up in the resonant transformer in strike mode, enabling a voltage multiplier to output a now pulsed higher voltage with a lower number of stages and a smaller input transformer. In order for this to work, the input stage capacitances on the multiplier are increased.

The power flow of this device starts in two 40 mAh, 50 c rate discharge lithium polymer batteries although it will be appreciated that other batteries with different properties can be used as well. The batteries are connected to a 125 mg—four-channel receiver that includes of several microchips connected point to point, for example, via a welding process to reduce weight. Then the current can be applied to a push pull modern version of the Royer circuit, driving a low profile drum shaped transformer. The transformer is about 7 mm in diameter in the current embodiment. The transformer is wound with all quadruple coated magnet wire 50AWG on the secondary and 36AWGQ silver on the primary.

In one implementation, the transformer is adapted from a BXA-302 inverter, with the circuit board discarded, as the outer ring was removed so as only to use the drum component. The connections on the bottom were cut with a Dremel tool in order to insure that the secondary coil of the transformer operated in a floating manner, since originally the transformer was grounded through the bottom plate. Such a ground was unacceptable for the 3 kV operation required of the new system. After adding new better insulated windings there must be a bubble free layer of epoxy added between the secondary and primary coils. The primary coil is longer than the original one so as to operate more efficiently with 6 to 8 volts input, as it was only originally designed for about a 3.5 volt continuous input. A much larger inductor was substituted as it was found to give a better q factor and increase the efficiency and overall output of the system substantially. Since the transformer is really operating in strike mode, it is able to output up to 5 kV instead of the 880 Volts×2 that would be expected from 1 to 100 or a 110 step up ratio in a push pull system. Generally under the required load it did not exceed 3 kV output. Significant power efficiencies are realized via a low-profile, well-insulated drum shaped transformer with a push pull inverter.

Conventional wisdom has generally resulted in previous ionocraft builders/inventors placing their emitter wires lower and closer to the collector surfaces in order to get the most lift. The inventor has determined that significant gains in efficiency can be realized by deliberately raising the emitter wires distance to the collector, as shown in this patent to at least around 6 to 8 inches.

The inventor has discovered that if the power supply wires are connected to one place on the large emitter assembly and also one place on the large collector assembly, the craft will create most of its propulsion/wind from that connection area. The solution to this poorly distributed and therefore less efficient propellant flow is to have current distribution wires connected at regular intervals on both the collector and emitter. This is particularly helpful for spiral shaped embodiments. A spiral shaped craft would seem to have the least number of corners on the collector and emitter surfaces; however, since many current balancing/distribution wires are needed to create an even propellant flow the advantages over simple concentric circles are negated. Concentric circles provide much more structural rigidity and resist twisting forces with less weight. It should be noted, however, that the inventor has found both configurations to be suitable for unassisted ion powered flight, and implementations of each have been made that are capable of lifting their own power supplies.

The inventor has determined empirically that having the emitter connected to the negative end of the power source is more quiet and efficient than connecting it to the positive terminal. This is the opposite of much of the literature. Steering can be accomplished by connecting the receiver outputs to two separate onboard actuators that operate four strings of variable resistors in order to attenuate the voltage to one or more of the four quadrants of the aerospace vehicle. Optical flow sensors in combination with microgyroscopic and accelerometer IMU stabilization is the best way to maintain absolute six axis control of the device.

Other embodiments of this device can be powered by very extensive piles of high voltage thin film batteries, as mentioned, or special extremely light weight voltage multiplier towers. These power supplies could use sub-nanosecond pulses to reduce arcing and increase the lift forces dramatically. Another element of these towers is to design them to produce five megavolts or more in order to take advantage of the relativistic effects of electrons at high voltages. Megavolt towers have been built that demonstrate encouragingly that lighter higher voltage designs can be made. At around five to ten MV, the craft should fly due to expelled electrons only, entirely independent of the atmosphere depending on the total system weight and the power to weight ratio of the initial power source. A similar craft operated with the emitter connected to the positive terminal of the power supply instead will produce a significant amount of ozone, and if large enough crafts are made they could be flown high in the atmosphere and might help reverse global warming. This should be practically implementable as there is no insurmountable barrier that would prevent these devices from being scaled up, improved, or modified for such a task.

From the above description of the invention, those skilled in the art will perceive improvements, changes, and modifications. Such improvements, changes, and modifications within the skill of the art are intended to be covered by the appended claims.

Having described the invention, I claim:

1. A self-contained ion powered aircraft assembly comprising:

a collector assembly;

an emitter assembly; and a control circuit operatively connected to at least the emitter assembly and the collector assembly and comprising an onboard power supply configured to provide voltage to the emitter assembly and the collector assembly, such that when powered only by the onboard power supply, the self-contained ion powered aircraft assembly provides sufficient vertical thrust to lift all of the self-contained ion powered aircraft assembly against a downward gravitational acceleration of 9.81 m/s2 without external assistance.

2. The self-contained ion powered aircraft assembly of claim 1, wherein the collector assembly comprises a plurality of concentric elements, with a central support of the self-contained ion powered aircraft assembly located at a common centroid of the plurality of concentric elements.

3. The self-contained ion powered aircraft assembly of claim 2, wherein each of the plurality of concentric elements are hexagonal.

4. The self-contained ion powered aircraft assembly of claim 2, wherein the control circuit is implemented on or within the central support.

5. The self-contained ion powered aircraft assembly of claim 4, wherein the central support is formed from a flexible printed circuit board rolled into a tube.

6. The self-contained ion powered aircraft assembly of claim 2, further comprising a plurality of peripheral supports, each of the plurality of peripheral supports extending perpendicularly to a plane defined by the plurality of concentric elements; and the emitter assembly comprising:

an emitter wire support structure, spaced from the collector assembly by the plurality of peripheral supports and the central support, comprising a series of supporting elements each extending within a plane parallel to the collector assembly; and a plurality of conductive emitter wires supported by the emitter wire support structure.

7. The self-contained ion powered aircraft assembly of claim 6, wherein the emitter assembly further comprises a rigid outer member, supported by the plurality of peripheral supports, a series of radial threads attached on at least one end to the rigid outer member, and the series of supporting elements comprising a plurality of concentric threads supported by the series of radial threads, the plurality of conductive emitter wires being attached along the plurality of concentric threads.

8. The self-contained ion powered aircraft assembly of claim 6, a closest distance between a conductive portion of the collector assembly and a conductive portion of the emitter assembly being more than fifteen percent of a width of the collector assembly.

9. The self-contained ion powered aircraft assembly of claim 1, the collector assembly being tapered such that a first edge of the collector assembly facing the emitter assembly is wider than a second edge, opposite the first edge, facing away from the emitter assembly.

10. The self-contained ion powered aircraft assembly of claim 1, the control circuit comprising a resonant transformer that is continuously driven at an associated resonant frequency.

11. The self-contained ion powered aircraft assembly of claim 10, the control circuit comprising an inverter configured to receive a direct current (DC) signal from the power supply and provide an alternating current (AC) signal to the resonant transformer.

12. The self-contained ion powered aircraft assembly of claim 10, the resonant transformer providing an output to a voltage multiplier.

13. The self-contained ion powered aircraft assembly of claim 12, wherein the voltage multiplier extends across all of the length of the central support.

14. The self-contained ion-powered aircraft of claim 12, the voltage multiplier comprising a modified Cockroft-Walton half wave multiplier comprising a ladder network of capacitors and diodes with a plurality of circuit paths containing diodes, in each circuit path containing each diode is curved to form a convex shape.

15. An ion powered aircraft assembly comprising:

a collector assembly comprising at least three concentric conductive elements;

an emitter assembly; and a control circuit operatively connected to at least the emitter assembly and the collector assembly and comprising an onboard power supply to provide voltage to the emitter assembly and the collector assembly, when powered only by the onboard power supply, the ion powered aircraft assembly provides sufficient vertical thrust to lift all of the ion powered aircraft assembly against a downward gravitational acceleration of 9.81 m/s2 without external assistance.

16. The ion powered aircraft assembly of claim 15, the control circuit comprising the control circuit comprising a resonant transformer that is continuously driven at an associated resonant frequency to drive the resonant transformer in a strike mode to provide a high voltage signal to another component of the control circuit.

17. An ion powered aircraft assembly comprising:

a collector assembly comprising a plurality of concentric elements, with a central support of the self-contained ion powered aircraft assembly located at a common centroid of the plurality of concentric elements;

a plurality of peripheral supports, each of the plurality of peripheral supports extending perpendicularly to a plane defined by the plurality of concentric elements;

an emitter assembly, comprising:

an emitter wire support structure, spaced from the collector assembly by the plurality of peripheral supports and the central support and comprising a series of supporting elements each extending within a plane parallel to the collector assembly; and a plurality of conductive emitter wires supported by the emitter wire support structure; and a control circuit operatively connected to at least the emitter assembly and the collector assembly and comprising an onboard power supply to provide voltage to the emitter assembly and the collector assembly and a resonant transformer that is continuously driven at an associated resonant frequency to provide a high voltage signal to another component of the control circuit, each of the collector assembly, the emitter assembly, and the control circuit being configured such that the ion powered aircraft assembly provides sufficient thrust to lift each of the collector assembly, the emitter assembly, and the control circuit against gravity wherein a closest distance between a conductive portion of the collector assembly and a conductive portion of the emitter assembly is more than fifteen percent of a width of the collector assembly.

18. The ion powered aircraft assembly of claim 17, the collector assembly comprising at least three concentric conductive elements.

* * * * *